US005639356A

United States Patent [19]

Levine

[11] Patent Number: 5,639,356

[45] Date of Patent: Jun. 17, 1997

[54] FIELD EMISSION DEVICE HIGH VOLTAGE PULSE SYSTEM AND METHOD

[75] Inventor: Jules D. Levine, Dallas, Tex.

[73] Assignee: Texas Instruments Incorporated, Dallas, Tex.

[21] Appl. No.: 535,504

[22] Filed: Sep. 28, 1995

[51] Int. Cl.[6] ..... B08B 6/00

[52] U.S. Cl. ..... 204/164; 205/705; 134/1; 313/309

[58] Field of Search ..... 204/164; 205/705; 134/1; 313/309; 445/24

[56] References Cited

U.S. PATENT DOCUMENTS 3,233,137 2/1966 Anderson et al. ..... 204/164

3,654,108 4/1972 Smith ..... 204/164

5,453,659 9/1995 Wallace et al. ..... 313/496

*Primary Examiner*—Kathryn L. Gorgos

*Assistant Examiner*—Kishor Mayekar

*Attorney, Agent, or Firm*—Christopher L. Maginniss; James C. Kesterson; Richard L. Donaldson

[57] ABSTRACT

To prevent degradation of field emission in a field emission device (FED) (10) resulting from the accumulation of contaminating impurities on the surface (42) of the microtips (26) of the FED (10), a high voltage pulse is applied at a cathode voltage control (46) connected between a grid conductor layer (24) and a metal mesh (18) of the FED (10). Upon application of the pulse, the impurities are desorbed from the surface (42) of the microtips (26) and are captured by a getter (44), which binds the impurities to its surface.

20 Claims, 1 Drawing Sheet

FIELD EMISSION DEVICE HIGH VOLTAGE PULSE SYSTEM AND METHOD

TECHNICAL FIELD OF THE INVENTION

This invention relates in general to the field of electronic devices and more particularly to an improved high voltage pulse system and method for a field emission device.

BACKGROUND OF THE INVENTIQN

Cathode degradation in a field emission device (FED) is often caused by electron beam-induced desorption of gases from the anode of the device. These gases, along with other contaminating materials present in the FED, tend to settle on the surface of the microtips of the cathode during operation and manufacture of the FED, causing field emission from the cathode to degrade over time due to changes in the work function of the material comprising the microtips. The change in the fractional coverage of the microtips by contaminating impurities is a function of the pressure in the FED plus the arrival rate of contaminating impurities on the surface of the microtips minus the departure rate of contaminating impurities from the surface of the microtips.

Degradation in field emission in an FED over time may also be caused by the diffusion of contaminating impurities over the surface of the microtips of the FED. Field emission from an FED is aided if the microtips of the FED remain free of impurities during both manufacture and operation of the FED.

SUMMARY OF THE INVENTION

Accordingly, a need has arisen for a system and method able to maintain the cleanliness of the microtips of an FED in order to prevent the degradation in field emission produced by the accumulation of contaminating impurities on the surface of the microtips of the FED. In accordance with the teachings of the present invention, a high voltage pulse system and method is provided that substantially eliminates or reduces disadvantages associated with the operation of FEDs.

According to one embodiment of the present invention, a high voltage pulse is applied by a cathode voltage control coupled between the grid conductor layer and the metal mesh of the FED at startup of the FED. The application of a cathode control voltage in the form of a high voltage pulse desorbs contaminating impurities, such as gases and adsorbates, from the surface of the microtips of the FED. The desorbed impurities migrate to a getter, which binds the desorbed gases and adsorbates to its surface.

According to an embodiment of the invention, the high voltage pulse may be applied during manufacture of the FED. In this mode, the high voltage pulse is applied while the FED is attached to a sealing station during manufacture. The desorbed gases and impurities are removed from the FED by an evacuation pump, and the FED is sealed.

An important technical advantage of the disclosed invention is the maintenance of the cleanliness of the microtips of the FED during both manufacture and operation of the FED. The high voltage pulse can be applied during the manufacture of the device, and also at each startup of the device to rid the microtips of the FED of contaminating impurities that have accumulated on the surface of the microtips since the previous startup of the device.

BRIEF DESCRIPTION OF THE DRAWINGS

A more complete understanding of the present invention and the advantages associated therewith may be acquired by referring to the accompanying drawings in which like reference numbers indicate like features and wherein.

DETAILED DESCRIPTION OF THE INVENTION

Figure 1:
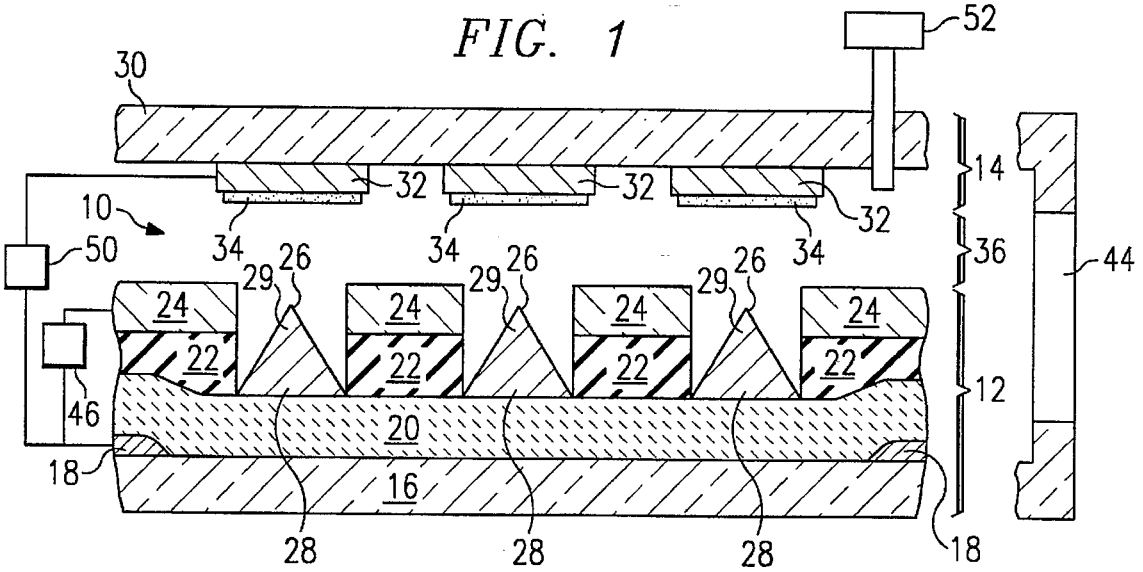
FIG. 1 is a cross-sectional schematic diagram of a field emission device.

FIG. 1 illustrates a field emission device (FED) indicated generally at 10 comprising a cathode 12 and an anode 14. Cathode 12 comprises a substrate 16, which may comprise, for example, a sheet of glass. Formed on one side of substrate 16 is a metal mesh 18, which may comprise, for example, niobium. A lateral resistive layer 20 is formed outwardly from and covers metal mesh 18 and the exposed portions of substrate 16. Lateral resistive layer 20 may compromise a layer of semiconductor material such as amorphous silicon.

An intercathode insulator layer 22 is disposed outwardly from lateral resistive layer 20. Intercathode insulator layer 22 may comprise, for example, silicon dioxide. Disposed outwardly from intercathode layer 22 is a grid conductor layer 24 which may comprise, for example, niobium. Intercathode layer 22 and grid conductor layer 24 each have a plurality of overlapping openings that house microtips 26. Microtips 26 are spaced in rows and columns in grid conductor layer 24. The three microtips 26 shown in FIG. 1 are representative of a row of microtips 26 in FED 10. Microtips 26 comprise conical bodies of a metal such as molybdenum. Each microtip has a base 28 and a tip 29. Each base 28 of each of microtips 26 is disposed on lateral resistive layer 20. According to one embodiment of the present invention, each microtip 26 is approximately 1 micron in diameter and 1 micron in height.

Anode 14, which is disposed opposite of cathode 12, includes an anode glass layer 30, which acts as a substrate for the remainder of anode 14. A plurality of indium tin oxide (ITO) electrodes 32 are disposed outwardly from anode glass layer 30. Indium tin oxide is a transparent, conductive oxide. A phosphor layer 34 is disposed outwardly from each of ITO electrodes 32. A vacuum layer 36 exists between cathode 12 and anode 14. According to one embodiment of the present invention, cathode 12 and anode 14 are spaced approximately 200 microns apart.

In operation, upon the application of an electric field to FED 10, electrons are emitted into vacuum layer 36 from cathode 12 and are accelerated to anode 14 as a result of a voltage bias between cathode 12 and anode 14. To accomplish field emission, a voltage bias of approximately 100 volts is applied at grid conductor layer 24, which in turn induces an electric field on the order of $5\times10^7$ volts per centimeter at each microtip. This comprises an electric field strength adequate for field emission from the microtip. A voltage bias of 1000 volts is applied at ITO electrodes 32 to accelerate the emitted electrons to phosphor layer 34. Anode 14 collects the emitted electrons, and, as the electrons strike phosphor layer 34, phosphor layer 34 converts a portion of the absorbed primary energy into luminescent radiation. ITO electrodes 32 are transparent and allow phosphor layer 34 to be seen through anode glass layer 30.

Figure 2:
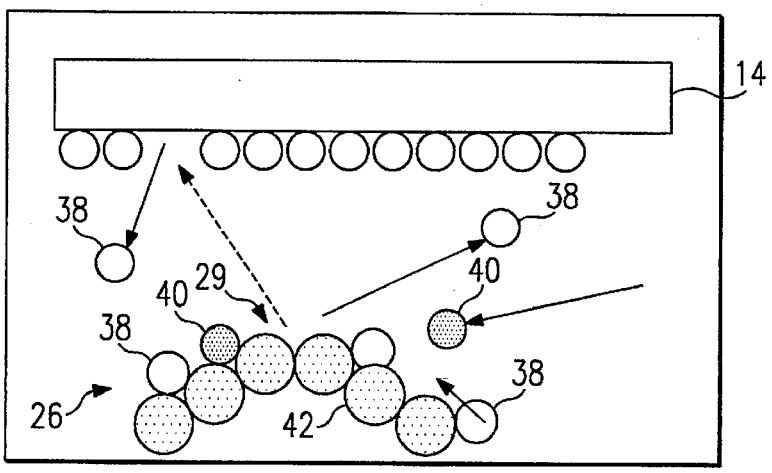
FIG. 2 is an enlarged schematic diagram of the tip and surface of a microtip of a field emission device.

As shown in FIG. 2, during manufacture and operation of FED 10, and despite attempts to maintain a high vacuum in vacuum layer 36 of FED 10, gases 38 are sometimes present on anode 14 and migrate from anode 14 to cathode 12 under the presence of an electric field. Anode glass layer 30, ITO electrode 32, and phosphor layer 34 are each potential sources of gases 38 in FED 10. Contaminating adsorbates 40 may also be present in FED 10 and can accumulate on surface 42 of microtips 26 during operation and manufacture of FED 10. The presence of contaminating impurities, such as gases 38 and adsorbates 40, on surface 42 of microtips 26 raises the work function of microtips 26 and degrades field emission from cathode 12.

The measure of the portion of surface 42 of microtips 26 that is covered by contaminating impurities is known as the fractional impurity coverage of surface 42 of microtips 26. The change in the fractional impurity coverage versus time, which represents the rate at which contaminating impurities are accumulating on the surface 42 of microtip 26, is measured by the pressure in vacuum layer 36 near microtip 26 plus the desorption of contaminating impurities from anode 14 minus the desorption of contaminating impurities from cathode 12. Because the desorption of contaminating materials from anode 12 and cathode 14 are both functions of the electric field in FED 10, a range of electric field intensity exists in which the change in the fractional impurity coverage over time is negative, indicating that the departure rate of contaminating impurities from surface 42 of microtips 26 is greater than the arrival rate of contaminating impurities on surface 42 of microtips 26. The electric field necessary to provide a negative rate of change over time in the fractional impurity coverage of surface 42 of microtips 26 can be produced by the application of a voltage pulse at grid conductor layer 24.

The adhesion energy of an absorbate may be expressed as follows:

$$\phi_a=\phi_o-c\propto E^2$$

where $\phi_a$ is the adhesion energy; $\phi_o$ is a constant energy; c is a constant; $\propto$ is atomic polarization; and E is the electric field. From this the rate of desorption may be expressed as follows:

$$\text{Rate}\sim e^{-\phi a/kT}$$

where k is a constant and T is temperature. From these relationships, it is apparent that a sufficient positive or negative electric field will cause the adhesion energy to be reduced such that absorbates will be desorbed from the surfaces of the microtips.

The existence of a local pressure in the area of cathode 12 contributes to a positive rate of change over time in the fractional impurity coverage, which indicates that more contaminating impurities are arriving at cathode 12 than are desorbed from cathode 12. Therefore, to assist in maintaining a vacuum in FED 10, a getter 44, shown in FIG. 1, binds stray gases 38 and adsorbates 40 on its surface. Getter 44 is disposed in the periphery of FED 10 and is comprised of a long, thin body of a metal, such as thallium, barium, or a barium compound. The metal of getter 44 becomes active after heating, which can be accomplished, for example, by the application of a radio frequency signal.

Figure 3:
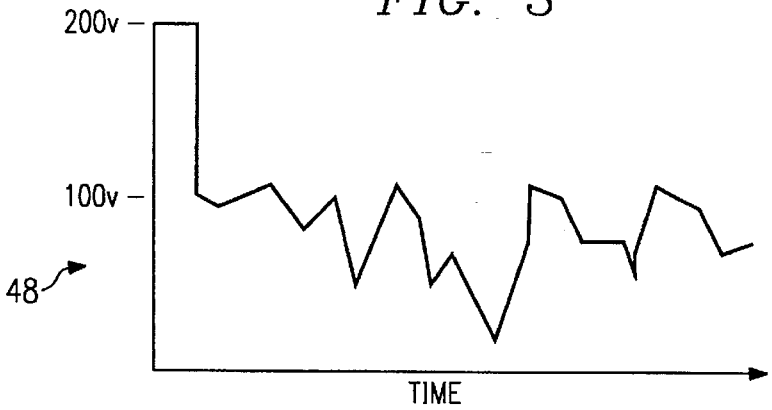
FIG. 3 is a graphical representation of the voltage applied by the cathode voltage control versus time.

The ordinary operating voltage applied at grid conductor layer 24 of cathode 12 is 100 volts. As shown in FIG. 3, upon the application of a voltage pulse 48 of between 120 and 200 volts at grid conductor layer 24 by cathode voltage control 46 of FIG. 1, an electric field is created in the region of cathode 12, which in turn induces field emission from cathode 12. The application of high voltage pulse 48 by cathode voltage control 46 causes desorption of contaminating impurities from microtip 26. The desorbed contaminating impurities are captured by getter 44. Thus, the application of high voltage pulse 48 at grid conductor layer 24 of cathode 12 allows FED 10 to operate such that the departure rate of contaminating impurities from surface 42 of microtips 26 is greater than the arrival rate of contaminating impurities on surface 42 of microtips 26. Because the magnitude of high voltage pulse 48 applied at grid conductor layer 12 is more important than the duration of the pulse, a high voltage pulse on the order of 150 to 200 volts may be applied to grid conductor layer 24 for as little as 1 second.

During high voltage pulse 48 at cathode 12, anode 14 is maintained at zero volts by the application of an anode control voltage by anode voltage control 50. During high voltage pulse 48, field emission from cathode 12 is briefly elevated. Maintaining anode 14 at zero volts during high voltage pulse 48 minimizes the possibility of arcing and, since emitted electrons from cathode 12 are not accelerated to anode 14, prevents light output at phosphor layer 34.

As shown in FIG. 1, microtips 26 of FED 10 are arranged in rows, or lines. High voltage pulse 48 is applied to microtips 26 of FED 10 on a line-at-a-time (LAAT) basis at startup of FED 10. Each row of microtips 26 is pulsed by a cathode voltage control, and each microtip disposed on a single line receives the applied pulse 48 simultaneously.

In order to keep cathode 12 of FED 10 clean during both manufacture and operation, high voltage pulse 48 may be applied to cathode 12 during manufacture of FED 10 while FED 10 is connected to a manufacturing sealing station. Once impurities are desorbed from cathode 12 by high voltage pulse 48, the impurities are captured by a manufacturing evacuation pump 52. FED 10 may then be sealed. Later, during operation of FED 10, LAAT application of voltage pulse 48 is applied at each startup of FED 10. Despite the presence of getter 44, microtips 26 of cathode 12 may become contaminated between startups because of continued migration of gases 38 from anode 14 to cathode 12. Contamination of microtips 26 between startups may also be caused by surface diffusion of contaminating materials on surface 42 of each of microtips 26.

As shown in FIG. 3, surface diffusion is characterized by the movement of impurities from base 28 to tip 29 of microtip 26 to replace those impurities desorbed during the previous high voltage pulse. Thus, application of a high voltage pulse at each startup cleans microtip 26 of both those contaminating impurities that have accumulated on microtip 26 as a result of electron stimulated desorption of gases from anode 14, and those contaminating impurities that have diffused to tip 29 of microtip 36 as a result of surface diffusion. LAAT pulsing of cathode 12 at a voltage of between 120 and 200 volts at each startup of FED 10 desorbs contaminating impurities from surface 42 of each of microtips 26, where they are captured by getter 44, thereby preventing a degradation in field emission from cathode 12 as a result of the accumulation of contaminating impurities on surface 42 of each of microtips 26.

Although the present invention has been described in detail, it should be understood that various changes, alterations, and substitutions may be made to the teachings herein without departing from the spirit and scope of the present invention which is defined solely by the appended claims.

What is claimed is:

1. A method for cleaning contaminating impurities from a microtip of a field emission device, comprising the steps of:

providing a field emission device having a grid conductor layer and a metal mesh;

applying a voltage pulse between the grid conductor layer and the metal mesh such that contaminating impurities are desorbed from a microtip of the field emission device, the voltage pulse being substantially greater than an ordinary operating cathode control voltage applied between the grid conductor layer and the metal mesh; and providing a getter associated with the field emission device to capture the desorbed impurities.

2. The method for cleaning a microtip of a field emission device of claim 1, wherein the step of applying a voltage pulse comprises the step of applying a voltage pulse having a voltage of between 120 and 200 volts between the grid conductor layer and the metal mesh such that contaminating impurities are desorbed from the microtip of the field emission device, the voltage pulse being greater than an ordinary operating cathode control voltage applied between the grid conductor layer and the metal mesh.

3. The method for cleaning a microtip of a field emission device of claim 1, wherein the step of applying a voltage pulse comprises the step of applying a voltage pulse having a voltage of between 150 and 200 volts for a period of 1 second between the grid conductor layer and the metal mesh such that contaminating impurities are desorbed from the microtip of the field emission device, the voltage pulse being greater than an ordinary operating cathode control voltage applied between the grid conductor layer and the metal mesh.

4. The method for cleaning a microtip of a field emission device of claim 1, further comprising the steps of:

providing a transparent electrode in the field emission device opposite the grid conductor layer and the metal mesh; and maintaining an anode control voltage of zero volts between the transparent electrode and the metal mesh of the field emission device.

5. The method in accordance with claim 4 wherein the transparent electrode comprises indium tin oxide (ITO).

6. The method for cleaning a microtip of a field emission device of claim 1, wherein the step of applying the voltage pulse comprises the step of applying a voltage pulse having a voltage of between 120 and 200 volts between the grid conductor layer and the metal mesh such that contaminating impurities are desorbed from the microtip of the field emission device, the voltage pulse being greater than an ordinary operating cathode control voltage applied between the grid conductor layer and the metal mesh; and further comprising the steps of:

providing a transparent electrode in the field emission device opposite the grid conductor layer and the metal mesh; and maintaining an anode control voltage of zero volts between the transparent electrode and the metal mesh of the field emission device.

7. The method for cleaning a microtip of a field emission device of claim 1, wherein the step of applying the voltage pulse comprises the step of applying a voltage pulse having a voltage of between 150 and 200 volts for a period of 1 second between the grid conductor layer and the metal mesh such that contaminating impurities are desorbed from the microtip of the field emission device, the voltage pulse being greater than an ordinary operating cathode control voltage applied between the grid conductor layer and the metal mesh; and further comprising the steps of:

providing a transparent electrode in the field emission device opposite the grid conductor layer and the metal mesh; and maintaining an anode control voltage of zero volts between the transparent electrode and the metal mesh of the field emission device.

8. The method for cleaning a microtip of a field emission device of claim 1, wherein the step of applying a voltage pulse comprises the step of applying a voltage pulse at startup of the field emission device between the grid conductor layer and the metal mesh such that contaminating impurities are desorbed from the microtip of the field emission device, the voltage pulse being greater than an ordinary operating cathode control voltage applied between the grid conductor layer and the metal mesh.

9. A method for cleaning contaminating impurities from a microtip of a field emission device, comprising the steps of:

providing a field emission device having a grid conductor layer and a metal mesh;

applying a voltage pulse during manufacture of the field emission device between the grid conductor layer and the metal mesh such that contaminating impurities are desorbed from a microtip of the field emission device;

evacuating the desorbed impurities with a manufacturing evacuation pump;

sealing the field emission device;

applying a voltage pulse at startup of the field emission device between the grid conductor layer and the metal mesh such that contaminating impurities are desorbed from the microtip; and providing a getter associated with the field emission device to capture the desorbed impurities.

10. The method for cleaning a microtip of a field emission device of claim 9, wherein the step of applying a voltage pulse at startup comprises the step of applying a voltage pulse having a voltage of between 120 and 200 volts at startup of the field emission device between the grid conductor layer and the metal mesh such that contaminating impurities are desorbed from the microtip.

11. The method for cleaning a microtip of a field emission device of claim 9, wherein the step of applying a voltage pulse at startup comprises the step applying a voltage pulse of between 150 and 200 volts for a period of 1 second between the grid conductor layer and the metal mesh at startup of the field emission device such that contaminating impurities are desorbed from the microtip.

12. The method for cleaning a microtip of a field emission device of claim 9, wherein the step of applying a voltage pulse at startup comprises the step applying a voltage pulse having a voltage of between 150 and 200 volts for at least 1 second between the grid conductor layer and the metal mesh at startup of the field emission device such that contaminating impurities are desorbed from the microtip.

13. The method for cleaning a microtip of a field emission device claim 9, further comprising the steps of:

providing a transparent electrode in the field emission device opposite the grid conductor layer and the metal mesh; and maintaining an anode control voltage of zero volts between the a transparent electrode and the metal mesh of the field emission device.

14. The method for cleaning a microtip of a field emission device of claim 9, wherein the step of applying a voltage pulse at startup comprises the step of applying a voltage pulse having a voltage of between 120 and 200 volts between the grid conductor layer and the metal mesh at startup of the field emission device such that contaminating impurities are desorbed from the microtip; and further comprising the steps of:

providing a transparent electrode in the field emission device opposite the grid conductor layer and the metal mesh; and maintaining an anode control voltage of zero volts between the transparent electrode and the metal mesh of the field emission device.

15. The method for cleaning a microtip of a field emission device of claim 9, wherein the step of applying a voltage pulse at startup comprises the step applying a voltage pulse having a voltage of between 150 and 200 volts for a period of 1 second between the grid conductor layer and the metal mesh at startup of the field emission device such that contaminating impurities are desorbed from the microtip; and further comprising the steps of:

providing a transparent electrode in the field emission device opposite the grid conductor layer and the metal mesh; and maintaining an anode control voltage of zero volts between the transparent electrode and the metal mesh of the field emission device.

16. The method for cleaning a microtip of a field emission device of claim 9, wherein the step of applying a voltage pulse at startup comprises the step applying a voltage pulse having a voltage of between 150 and 200 volts for at least 1 second between the grid conductor layer and the metal mesh at startup of the field emission device such that contaminating impurities are desorbed from the microtip; and further comprising the steps of:

providing a transparent electrode in the field emission device opposite the grid conductor layer and the metal mesh; and maintaining an anode control voltage of zero volts between the transparent electrode and the metal mesh of the field emission device.

17. A method for cleaning contaminating impurities from rows of microtips of a field emission device, comprising the steps of:

providing a field emission device having a grid conductor layer, a metal mesh, and a transparent electrode;

applying a voltage pulse during manufacture of the field emission device between the grid conductor layer and the metal mesh such that contaminating impurities are desorbed from rows of microtips;

evacuating the desorbed impurities with a manufacturing evacuation pump;

sealing the device;

maintaining an anode control voltage of zero volts between the transparent electrode and the metal mesh of the field emission device;

applying a voltage pulse at startup of the field emission device on a line-at-a-time basis between the grid conductor layer and the metal mesh such that the contaminating impurities are desorbed from the rows of microtips; and providing a getter associated with the field emission device to capture the desorbed impurities.

18. The method for cleaning rows of microtips of a field emission device of claim 17, wherein the step of applying a voltage pulse at stamrtup comprises the step of applying a voltage pulse having a voltage of between 120 and 200 volts between the grid conductor layer and the metal mesh on a line-at-a-time basis at startup of the field emission device such that the contaminating impurities are desorbed from the rows of microtips.

19. The method for cleaning rows of microtips of a field emission device of claim 17, wherein the step of applying a voltage pulse at startup comprises the step of applying a voltage pulse having a voltage of between 150 and 200 volts between the grid conductor layer and the metal mesh for a period of 1 second on a line-at-a-time basis at startup of the field emission device such that the contaminating impurities are desorbed from the rows of microtips.

20. The method for cleaning rows of microtips of a field emission device of claim 17, wherein the step of applying a voltage pulse at startup comprises the step of applying a voltage pulse having a voltage of between 150 and 200 volts between the grid conductor layer and the metal mesh for at least 1 second on a line-at-a-time basis at startup of the field emission device such that the contaminating impurities are desorbed from the rows of microtips.

* * * * *